US005983407A

United States Patent [19]

McKay

[11] Patent Number: 5,983,407

[45] Date of Patent: Nov. 16, 1999

[54] COCCYGEAL PROTECTIVE PAD

[76] Inventor: John C. McKay, 1406 Stanford, Houston, Tex. 77019

[21] Appl. No.: 09/072,380

[22] Filed: May 4, 1998

Related U.S. Application Data

[63] Continuation-in-part of application No. 08/202,733, May 16, 1994, abandoned.

[51] Int. Cl.[6] ..... A41D 13/00

[52] U.S. Cl. ..... 2/455; 2/467; 2/231; 602/19

[58] Field of Search ..... 2/455, 460, 463, 2/464, 465, 466, 467, 16, 23, 44, 267, 231; 602/5, 6, 19; 128/112.1, 115.1

[56] References Cited

U.S. PATENT DOCUMENTS

| | | | |
|---|---|---|---|
| 654,173 | 7/1900 | Mendenhall | 2/44 |
| 1,174,757 | 3/1916 | Packer | 602/19 |
| 1,401,056 | 12/1921 | Doyle | 602/19 |
| 2,633,572 | 4/1953 | Milstein | 2/464 |
| 3,170,163 | 2/1965 | Mitchell | 2/465 |
| 3,484,868 | 12/1969 | Davenport, Jr. | 2/465 |
| 3,710,391 | 1/1973 | McGlynn | 2/460 |
| 4,945,571 | 8/1990 | Calvert | 2/2 |
| 5,297,293 | 3/1994 | Obujen | 2/2 |
| 5,365,610 | 11/1994 | Lubahn et al. | 2/23 |
| 5,551,082 | 9/1996 | Stewart et al. | 2/2 |
| 5,619,747 | 4/1997 | Boisclair et al. | 2/465 |
| 5,649,328 | 7/1997 | Martin | 2/238 |

*Primary Examiner*—Michael A. Neas

*Attorney, Agent, or Firm*—Charles J. Rogers; Winstead Sechrest & Minick P.C.

[57] ABSTRACT

A protective pad worn under the trousers, hooked to the trousers or belt, for protecting skaters from spinal injury when falling. The pad has a substantially rigid central flat panel curved at the bottom to conform to the human form and a hook at the top for clipping to the trousers. A foamed synthetic resin member covers the front of the central panel and a high density foamed synthetic resin member covers the rear. The central panel and foamed members are encased in a fabric sheath. The hook protrudes through the fabric sheath. The central panel and front and rear foamed members are perforated by ventilation holes. A gel filled cushion provides additional shock absorbency.

11 Claims, 3 Drawing Sheets

COCCYGEAL PROTECTIVE PAD

REFERENCE TO RELATED APPLICATION

This application is a Continuation-In-Part of Ser. No. 08/202,733, filed May 16, 1994, now abandoned.

BACKGROUND

1. Field of the Invention

The present invention relates to protective guards, and more particularly to protective guards worn over the coccyx. The novel guard comprises a cushioned solid panel which clips to the belt or trousers of the user.

2. Description of the Related Art

Certain sports activities, such as ice skating, roller skating, and similar endeavors, are such that there is a significant chance that the legs of the player will slide out from under his or her body. A frequent consequence is that the player falls and lands on the coccyx. This occurrence can result in serious injury, since the coccyx is the base of the spine.

U.S. Pat. No. 5,127,610, issued to Richard Provasoli on Jul. 7, 1992, shows a spine protector. Provasoli's device is generally cruciform, comprising a bent, flat vertical member from which flat, curved wings project at the right and left center to complete the cruciform configuration. The device is formed from cellular polyvinyl chloride and is covered with dense foam. A fabric sheath encloses the cruciform member and foam cover. Provasoli's device bears hook and loop material for attachment to a paragliding harness with which it is intended to be used.

U.S. Pat. No. 2,633,572, issued to Victor Milstein on Apr. 7, 1953, shows a guard bearing clips for hooking to trousers. U.S. Pat. No. 4,945,571, issued to Nathaniel Calvert on Aug. 7, 1990, shows the inclusion of liquid cushions in protective apparel.

U.S. Pat. No. 5,297,293, issued to Douglas M. Obujen on Mar. 29, 1994, 5,551,082, issued to David H. Stewart et al. on Sep. 3, 1996, 5,649,328, issued to Eugence C. Martin on Jul. 22, 1997, and 5,619,747, issued to Carole Boisclair et al. on Apr. 15, 1997, all generally illustrate approaches to protecting the body from impacts. Boisclair et al. shows holes formed in a protective device.

None of the above inventions and patents, taken either singly or in combination, is seen to describe the present invention which provides an improved design for protection of the coccyx.

SUMMARY

The present invention provides a shield or protective pad suitable for protecting a sports enthusiast from impacts and abrasions to the coccyx. The novel protective pad is most advantageously employed in sports activities such as ice skating, roller skating, and similar pursuits wherein there is a substantial possibility of the user's legs abruptly sliding from a vertical supporting position beneath the torso when the user is standing, running, or otherwise disposed with the torso supported well above the ground. The novel protective pad also finds utility in activities performed with the torso disposed in close proximity to a supporting surface, such as riding on toboggans and seesaws, playing soccer, skiing, and others.

The novel protective pad is sufficiently flat as to be worn under clothing without unduly bulging, and has a clip for removably securing to trousers, belt, and the like. The clip enables the novel pad to be readily slipped into place in hooked relationship to the apparel without requiring fasteners to be mated. Since the pad is worn at the back of the body, manual access to fasteners is awkward and limited. The clip cooperates with ordinary apparel, not requiring a mating component to be present on the apparel. The protective pad is thus compatible with all manner of trousers or other apparel having an exposed edge at the waist.

The pad is curved to conform to the body. Should a person wearing the novel pad fall onto the coccyx, impact will be absorbed by two resilient protective members and one rigid central member collectively forming a three layer sandwich. The rigid member provides the structural base of the protective pad. A resilient, flexible member covers the rear surface of the rigid member. A second resilient, flexible member is provided at the front of the rigid member. The front and rear members provide considerable shock absorbing properties. The rigid member, apart from defining structural configuration and supporting the front and rear resilient members, serves to distribute forces from impact over greater area than would occur if the body encountered an object of area less than that of the protective pad. A gel filled cushion further absorbs impacts. The front and rear resilient members are protected from scratches and abrasion by a fabric sheath.

Comfort is imparted by ventilation holes extending through the three principal members. These holes minimize excessive perspiration at that portion of the back covered by the novel protective pad.

Accordingly, it is a principal object of the invention to provide a protective pad for the coccyx which may be hooked or clipped to trousers or similar apparel.

It is another object of the invention to provide protection against impacts and abrasion at the coccyx.

It is a further object of the invention to provide a protective pad which is readily installed and removed at the back of the body.

Still another object of the invention is to minimize perspiration arising from covering the body.

An additional object of the invention is to protect the novel pad from scratches and similar abrasion.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION

Various other objects, features, and attendant advantages of the present invention will become more fully appreciated as the invention becomes better understood when considered in conjunction with the accompanying drawings, in which like reference characters designate the same or similar parts throughout the several views.

DETAILED DESCRIPTION

Figure 1:
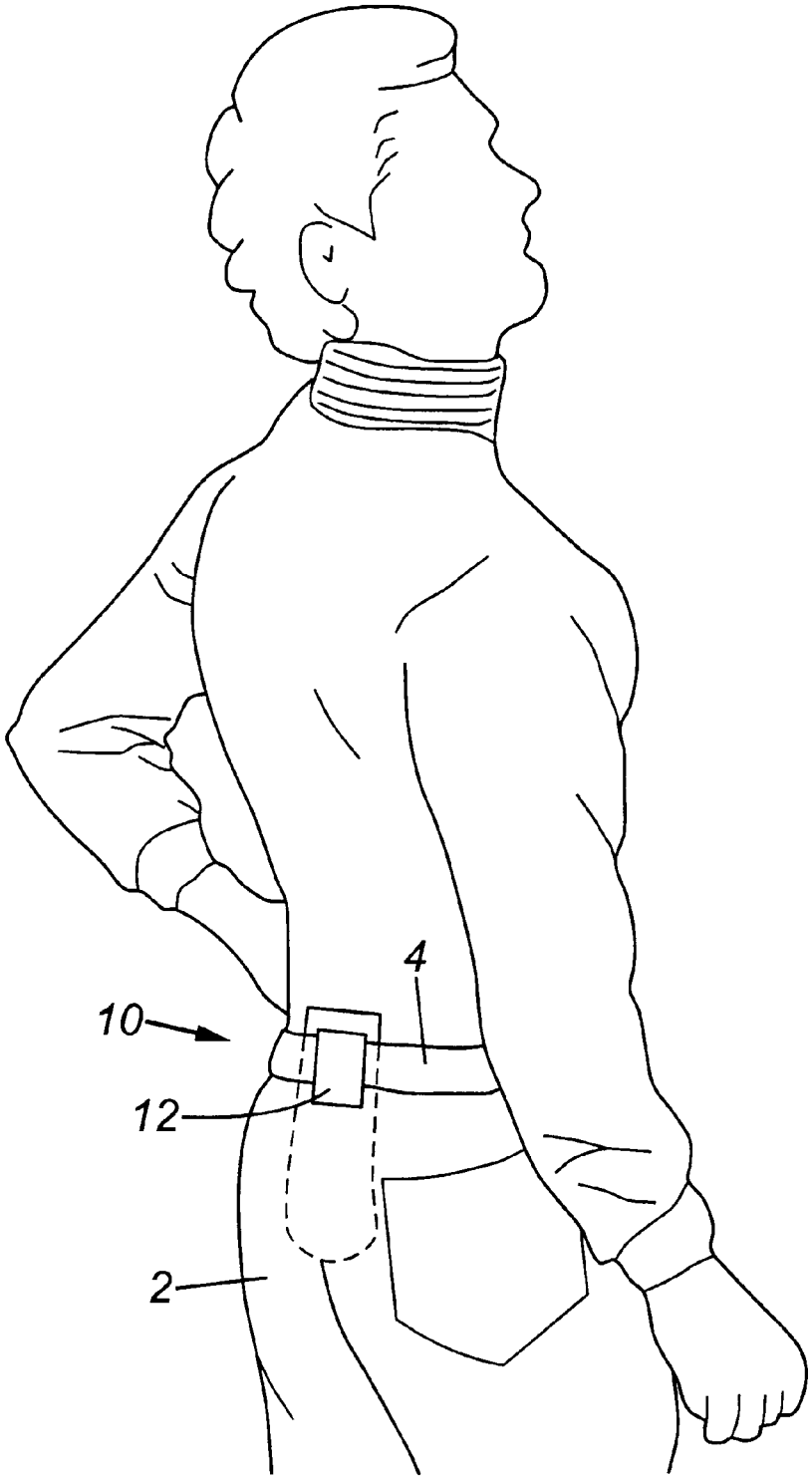
FIG. 1 is an environmental, perspective view of the invention.

The novel coccygeal protective pad 10 is shown as it would be worn by a user in FIG. 1. Pad 10 is fitted inside the trousers 2 or similar apparel, and clips to belt 4 or to the waistband of the apparel. Pad 10 is essentially concealed between the user's body and trousers 2, with only the uppermost portion and hook 12 visible. Pad 10 covers the center of the coccyx of the user when installed as shown in FIG. 1, and protects the coccyx from impacts arising from a fall.

Figure 2:
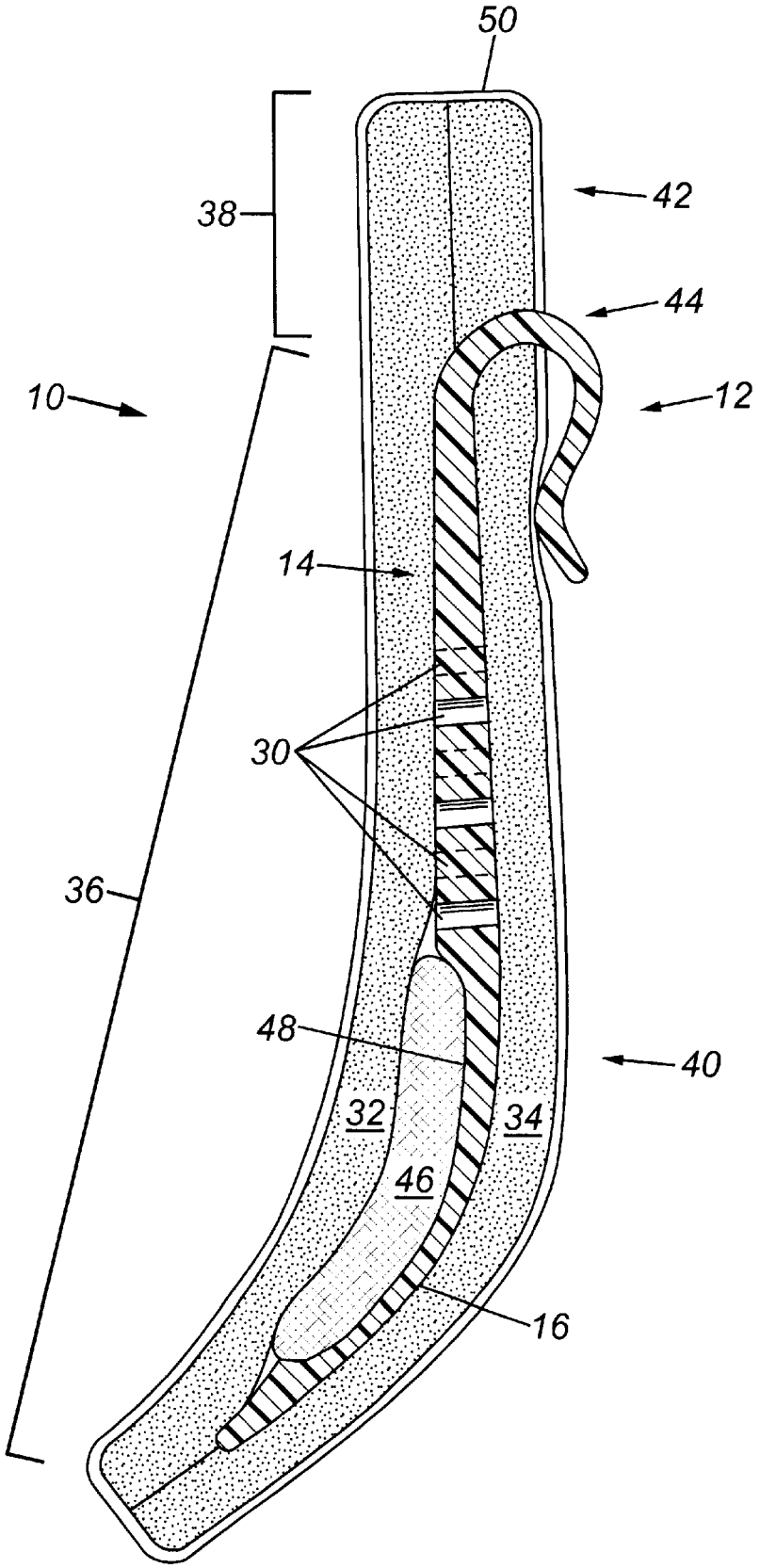
FIG. 2 is a side cross sectional view of the invention.
Figure 3:
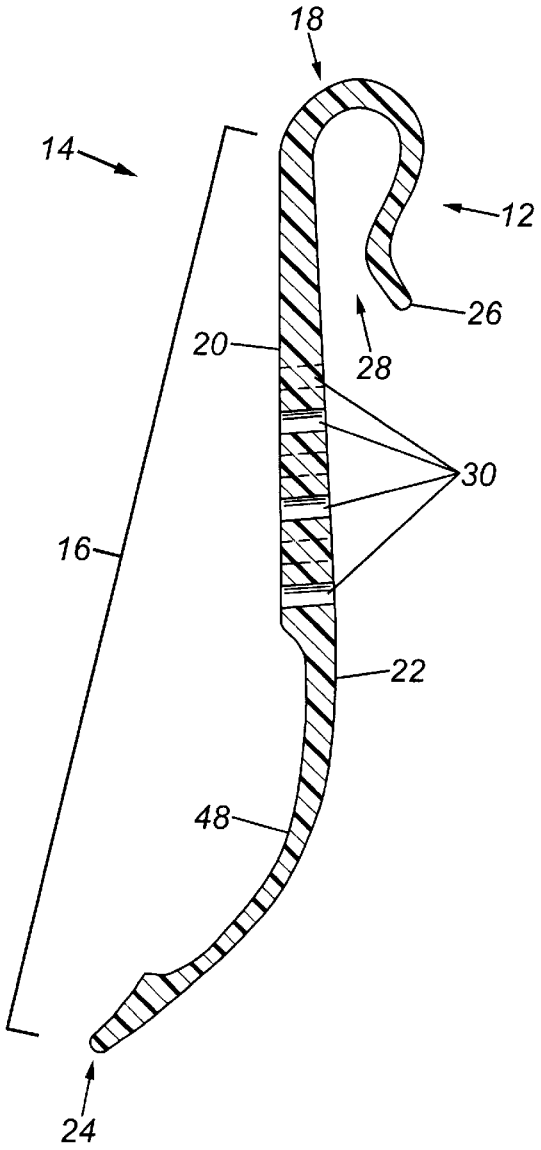
FIG. 3 is a side cross sectional detail view of a member shown at the center of FIG. 2.

FIGS. 2 and 3 illustrate construction of pad 10. Configuration of pad 10 is maintained by a substantially rigid base 14 (see FIG. 3) having a flat protective panel portion 16 joined to hook 12. Hook 12 is fixed to protective panel 16 at upper edge 18. Hook 12 is oriented to open downwardly, and is flared at distal end 26 of hook 12. Flaring signifies that hook 12 is configured to be inclined away from the narrowest passage formed between protective panel 16 and hook 12. The narrowest passage is indicated at 28. Flaring acts in the capacity of a guide enabling rapid installation of pad 10 as hook 12 is slipped over belt 4 or the waistband of trousers 2.

Protective panel 16 has a front surface 20, a rear surface 22, and a lower edge 24. Hook 12 is disposed behind rear surface 22 of protective panel 16. Protective panel 16 is curved at lower edge 24 in a direction projecting a way from hook 12.

Base 14 is formed from a substantially rigid material, such as acrylonitrile butadiene styrene (ABS), which may exhibit incidental flexibility, but has sufficient rigidity to maintain configuration of hook 14 and protective panel 16 under ordinary use, to resist forces from impacts, and to distribute these forces over a relatively large area. Because ABS is impervious to water, ventilation holes 30 are provided to discourage undue accumulation of perspiration when pad 10 is in use.

Protective panel 16 is covered by a flexible, resilient first covering member 32 disposed at and covering front surface 20 of protective panel 16, and by a flexible, resilient second covering member 34 disposed at and covering rear surface 22 of protective panel 16. Covering member 32 has a first section 36 overlying protective panel 16 at the front and a second section 38 extending above protective panel 16. Second covering member 34 has a first section 40 overlying protective panel 16 at the rear and a second section 42 extending above protective panel 16. Members 32 and 34 are fabricated from synthetic resin foam. Member 32 is preferably formed from a synthetic resin foam having memory characteristics, so that member 32 better conforms to body contours. Hook 12 penetrates through second covering member 34 at 44, thereby demarcating section 40 from section 42. A gel cushion 46 is received in a recess 48 formed in the front surface of protective panel 16. Gel cushion 46 is disposed between member 32 and protective panel 16. A stretchable fabric sheath 50 encloses covering members 32, 34 and protective pad 16. Sheath 50 may be fabricated from any suitable fabric, and provides resistance to abrasion which could otherwise degrade covering members 32, 34.

Protective panel 16 is of substantially constant thickness along its entire length, except for variation required to form recess 48. Front and rear covering members 32, 34 are of substantially constant thickness along their respective entire lengths, apart from distortion from compressing by hook 12.

Figure 4:
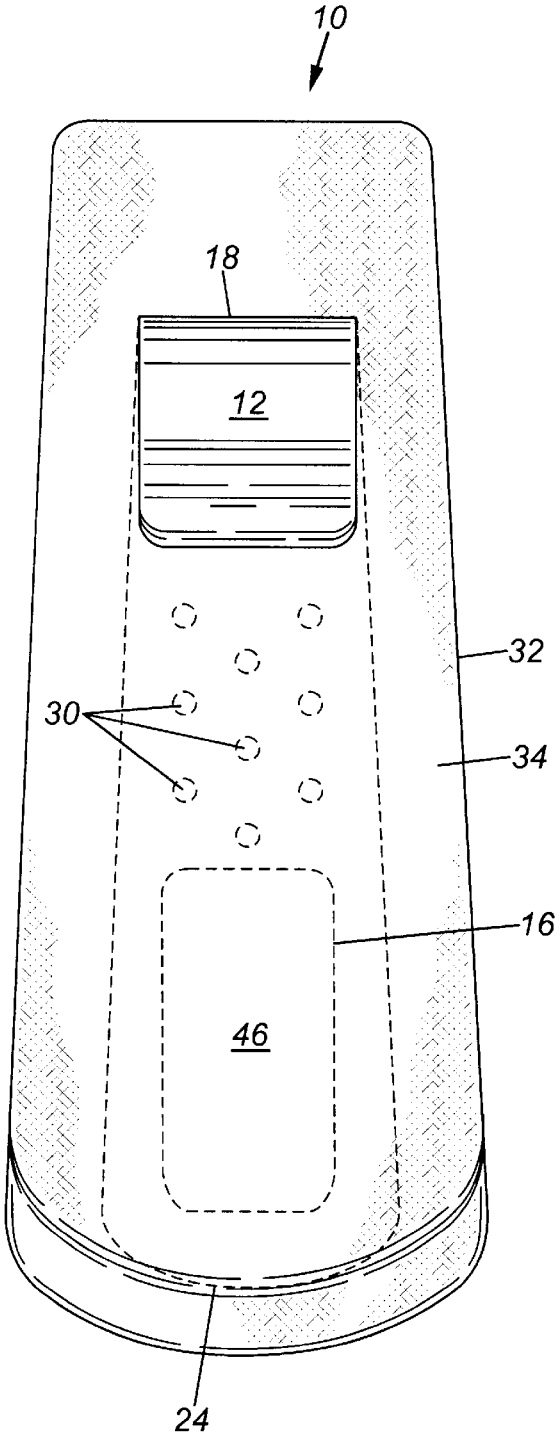
FIG. 4 is a rear elevational view of the invention.

Turning now to FIG. 4, covering member 34 is wider than protective panel 16, as well as being longer, as seen in FIG. 2. Covering member 32 is equally wide and long as covering member 34, so that covering members 32, 34 extend beyond and fully enclose protective panel 16. The body of a user thus never directly contacts rigid member 16, being shielded by resilient member 32 or 34. Protective panel 16 is of variable width, having a first width dimension at upper edge 18 and a second width dimension at lower edge 24. The first width dimension at upper edge 18 is less in magnitude than said second width dimension. The reason for this is that more area is required for protection against impacts at the coccyx, whereas protective panel 16 need be only wide enough at the top to satisfy requirements for hook 12.

It is to be understood that the present invention is not limited to the embodiments described above, but encompasses any and all embodiments within the scope of the following claims.

I claim:

1. A coccygeal protective pad comprising:

a substantially rigid base having a flat protective panel including a front surface, a rear surface, an upper edge, and a lower edge, a hook fixed to said upper edge of said protective panel and disposed behind said rear surface of said protective panel, said protective panel being curved away from said hook at said lower edge;

a flexible, resilient first covering member disposed at and covering said front surface of said protective panel; and a flexible, resilient second covering member disposed at said rear surface of and covering said protective panel.

2. The coccygeal protective pad according to claim 1, said first covering member having a first section overlying said protective panel and a second section extending above said protective panel, and said second covering member having a first section overlying said protective panel and a second section extending above said protective panel.

3. The coccygeal protective pad according to claim 1, said protective panel having holes passing therethrough.

4. The coccygeal protective pad according to claim 1, further comprising a fabric sheath enclosing said first covering member, said second covering member, and said protective panel.

5. The coccygeal protective pad according to claim 1, further comprising a gel cushion disposed at said front surface of said flat protective panel, and between said first covering member and said flat protective panel.

6. The coccygeal protective pad according to claim 1, wherein said first covering member is fabricated from a synthetic resin foam having memory characteristics.

7. The coccygeal protective pad according to claim 1, wherein said hook is oriented to open downwardly, has a distal end, and is flared at said distal end.

8. The coccygeal protective pad according to claim 1, wherein said protective panel, said first covering member, and said second covering member are of substantially constant thickness along their respective entire lengths.

9. The coccygeal protective pad according to claim 1, wherein said first covering member and said second covering member are wider than said protective panel along the entire length of said protective panel.

10. The coccygeal protective pad according to claim 1, said protective panel having a first width dimension at said upper edge and a second width dimension at said lower edge, said first width dimension being less in magnitude than said second width dimension.

11. A coccygeal protective pad comprising:

a substantially rigid base having a flat protective panel including a front surface, a rear surface, an upper edge, and a lower edge, a hook fixed to said upper edge of said protective panel and disposed behind said rear surface of said protective panel, said hook oriented to open downwardly, having a distal end, and being flared at said distal end, said protective panel being curved away from said hook at said lower edge, said protective panel having holes passing therethrough;

a flexible, resilient first covering member fabricated from a synthetic resin foam having memory characteristics, disposed at and covering said front surface of said protective panel;

a flexible, resilient second covering member fabricated from a synthetic resin foam, disposed at said rear surface of and covering said protective panel;

a gel cushion disposed at said front surface of said flat protective panel, and between said first covering member and said flat protective panel; and a fabric sheath enclosing said first covering member, said second covering member, and said protective panel, said first covering member having a first section overlying said protective panel and a second section extending above said protective panel, and said second covering member having a first section overlying said protective panel and a second section extending above said protective panel, wherein said protective panel, said first covering member, and said second covering member are of substantially constant thickness along their respective entire lengths, said first covering member and said second covering member are wider than said protective panel along the entire length of said protective panel, and said protective panel has a first width dimension at said upper edge and a second width dimension at said lower edge, said first width dimension being less in magnitude than said second width dimension.

* * * * *